US008336715B2

(12) United States Patent
Koga et al.

(10) Patent No.: US 8,336,715 B2
(45) Date of Patent: Dec. 25, 2012

(54) BANKNOTE PROCESSING DEVICE

(75) Inventors: Fumiaki Koga, Tokyo-To (JP); Osamu Ito, Kawaguchi (JP); Masakazu Miwa, Tokyo-To (JP); Kouichi Maekawa, Tokyo-To (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 397 days.

(21) Appl. No.: 12/449,412

(22) PCT Filed: Feb. 8, 2007

(86) PCT No.: PCT/JP2007/052190

§ 371 (c)(1),
(2), (4) Date: Aug. 6, 2009

(87) PCT Pub. No.: WO2008/096430

PCT Pub. Date: Aug. 14, 2008

(65) Prior Publication Data

US 2010/0006482 A1 Jan. 14, 2010

(51) Int. Cl.
*B07C 5/00* (2006.01)

(52) U.S. Cl. ..... 209/534; 209/552; 194/206; 194/207; 340/674

(58) Field of Classification Search ..... 209/534, 209/552; 194/206, 207
See application file for complete search history.

(56) References Cited

U.S. PATENT DOCUMENTS

| | | | | |
|---|---|---|---|---|
| 4,905,840 | A | 3/1990 | Yuge et al. | 209/534 |
| 6,771,180 | B2 * | 8/2004 | Mizuta et al. | 340/674 |
| 7,817,842 | B2 * | 10/2010 | Mennie | 382/137 |
| 2003/0121753 | A1 | 7/2003 | Stromme et al. | 194/207 |
| 2005/0150738 | A1 | 7/2005 | Hallowell et al. | 194/206 |
| 2009/0166269 | A1 * | 7/2009 | Tanaka et al. | 209/534 |
| 2011/0004337 | A1 * | 1/2011 | Doi | 700/223 |

FOREIGN PATENT DOCUMENTS

| | | |
|---|---|---|
| JP | 54-118138 | 9/1979 |
| JP | 59-211184 | 11/1984 |
| JP | 59-211185 | 11/1984 |
| JP | 03-097093 | 4/1991 |
| JP | 2005-346154 | 12/2005 |
| JP | 2006-096484 | 4/2006 |
| JP | 2006-350818 | 12/2006 |

OTHER PUBLICATIONS

European Search Report (dated Nov. 2, 2010—7 pages).

* cited by examiner

*Primary Examiner* — Terrell Matthews
(74) *Attorney, Agent, or Firm* — Renner, Kenner, Greive, Bobak, Taylor & Weber

(57) ABSTRACT

The banknote processing device 100 includes a first upper stacking unit 102*a* that is provided at an upper position of the banknote processing device and stacks rejected notes; a second upper stacking unit 102*b* that is provided adjacent to the first upper stacking unit and stacks banknotes other than the rejected notes; first to fourth lower stacking units 106*a*-106*d* that are arranged in parallel at lower positions of the banknote processing device and stack banknotes of at least one specific denomination; and a controller 111 that controls the transport unit to transport the banknote to the first upper stacking unit when a recognition result is a rejected note, and to transport the banknote to one of the second upper stacking unit and the first to fourth lower stacking units when the recognition result is not a rejected note.

11 Claims, 11 Drawing Sheets

BANKNOTE PROCESSING DEVICE

TECHNICAL FIELD

The present invention relates to a banknote processing device, and more particularly to a banknote processing device having at least two stacking units at upper positions of the device and having four stacking units at lower positions thereof.

BACKGROUND ART

Common banknote processing devices sort and stack banknotes placed on a hopper into plural staking units according to predetermined criteria. In contrast, banknote processing devices of Patent Documents 1 and 2 that efficiently sort more kinds of banknotes than the number of staking units are known.

The banknote processing device of Patent Document 1 stacks into one of three stacking units, banknotes that have failed to be sorted into the other two stacking units. In the banknote processing device of Patent Document 1, banknotes of designated denominations are sorted and stacked into the two stacking units, while banknotes of mixed denominations are stacked in the remaining stacking unit. Accordingly, the banknotes of the mixed denominations need to be placed again on the hopper and sorted. That is, when there are four or more denominations, the sorting process needs to be performed at least twice.

On the other hand, the banknote processing device of Patent Document 2 has seven stacking units and does not need to perform the sorting process twice or more times when there are seven or less denominations. However, when the number of stacking units increases, the size of the banknote processing device is enlarged, and the production cost increases accordingly. Further, some stacking units are unused depending on the number of denominations of banknotes to be sorted.

Both in the banknote processing devices of Patent Documents 1 and 2, the sorted banknotes and the banknotes having failed to be sorted are stacked in the stacking units arranged at lower positions of the devices. Therefore, it is difficult to know which stacking unit contains the banknotes having failed to be sorted.

[Patent Document 1] Japanese Patent Application Laid-open No. 2005-165805

[Patent Document 2] Japanese Patent Application Laid-open No. 2002-74464

THE OBJECT OF THE PRESENT INVENTION

The object of the present invention is to make the size of the banknote processing device (the number of the stacking units) a minimum configuration, to reduce the number of the banknote sorting processes, and to clearly show to the operator a distinction between the stacking units storing the banknotes that have been able to be sorted and the stacking units storing the banknotes that have failed to be sorted.

MEANS FOR ACHIEVING THE OBJECT

The first aspect of the present invention provides a banknote processing device that sorts and stacks plural banknotes, the banknote processing device comprising:

a take-in unit that is provided at an upper position of the banknote processing device and takes in the plural banknotes placed on the take-in unit one by one;

a recognition unit that recognizes the banknote taken in by the take-in unit;

a first upper stacking unit that is provided at an upper position of the banknote processing device and stacks rejected notes;

a second upper stacking unit that is provided adjacent to the first upper stacking unit and stacks banknotes other than the rejected notes;

first to fourth lower stacking units that are arranged in parallel at lower positions of the banknote processing device and stack banknotes of at least one specific denomination;

a transport unit that transports the banknote taken in by the take-in unit to one of the first and second upper stacking units and the first to fourth lower stacking units; and a controller that controls the transport unit to transport the banknote to the first upper stacking unit when a recognition result obtained by the recognition unit for the banknote is a rejected note, and to transport the banknote to one of the second upper stacking unit and the first to fourth lower stacking units when the recognition result obtained by the recognition unit for the banknote is not a rejected note.

The second aspect of the present invention provides a banknote processing device that sorts and stacks plural banknotes, the banknote processing device comprising:

a take-in unit that is provided at an upper position of the banknote processing device and takes in the plural banknotes placed on the take-in unit one by one;

a recognition unit that recognizes the banknote taken in by the take-in unit;

first and second upper stacking units that are provided adjacent to each other at upper positions of the banknote processing device and stack rejected notes;

first to fourth lower stacking units that are arranged in parallel at lower positions of the device and stack banknotes other than the rejected notes;

a transport unit that transports the banknote taken in by the take-in unit to one of the first and second upper stacking units and the first to fourth lower stacking units;

a detection unit that detects a transport error in the transport unit; and a controller that, when the transport error is detected for the banknote by the detection unit and when a denomination recognition error or authentication recognition error is detected for the banknote by the recognition unit, judges the banknote as a rejected note and controls the transport unit to transport the banknote to one of the first and second upper stacking units and, when the recognition result of the recognition unit is not a rejected note, controls the transport unit to transport the banknote to one of the first to fourth lower stacking units.

The third aspect of the present invention provides a banknote processing device that sorts and stacks plural banknotes, the banknote processing device comprising:

a take-in unit that is provided at an upper position of the banknote processing device and takes in the plural banknotes placed on the take-in unit one by one;

a recognition unit that recognizes the banknote taken in by the take-in unit;

a first upper stacking unit that is provided at an upper position of the banknote processing device and stacks rejected notes;

a second upper stacking unit that is provided adjacent to the first upper stacking unit and capable of selectively stacking rejected notes or banknotes other than the rejected notes;

first to fourth lower stacking units that are arranged in parallel at lower positions of the banknote processing device and stack banknotes other than the rejected notes;

a transport unit that transports the banknote taken in by the take-in unit to one of the first and second upper stacking units and the first to fourth lower stacking units;

a selection unit that selects the rejected note or the banknote other than the rejected note as the banknote to be stacked in the second upper stacking unit; and a controller that controls the transport unit to transport the banknote of a specific denomination to one of the first to fourth lower stacking units, transport the banknote other than the specific denomination to the second upper stacking unit, and transport the rejected note to the first upper stacking unit when the banknotes other than the rejected notes are selected by the selection unit, and controls the transport unit to transport the banknote other than the rejected note to one of the first to fourth lower stacking units and transport the rejected note to one of the first and second upper stacking units when the rejected notes are selected by the selection unit.

EFFECT OF THE PRESENT INVENTION

According to the present invention, the size of the banknote processing device (the number of the stacking units) can be a minimum configuration; the number of the banknote sorting processes can be reduced; and a distinction between the stacking units storing the banknotes that have been able to be sorted and the stacking units storing the banknotes that have failed to be sorted can be clearly shown to the operator.

BRIEF DESCRIPTION OF THE DRAWINGS

FIG. 4(*b*) is an explanatory diagram showing orientations of the banknotes.

EXPLANATION OF THE REFERENCE NUMERALS

Figure 1:
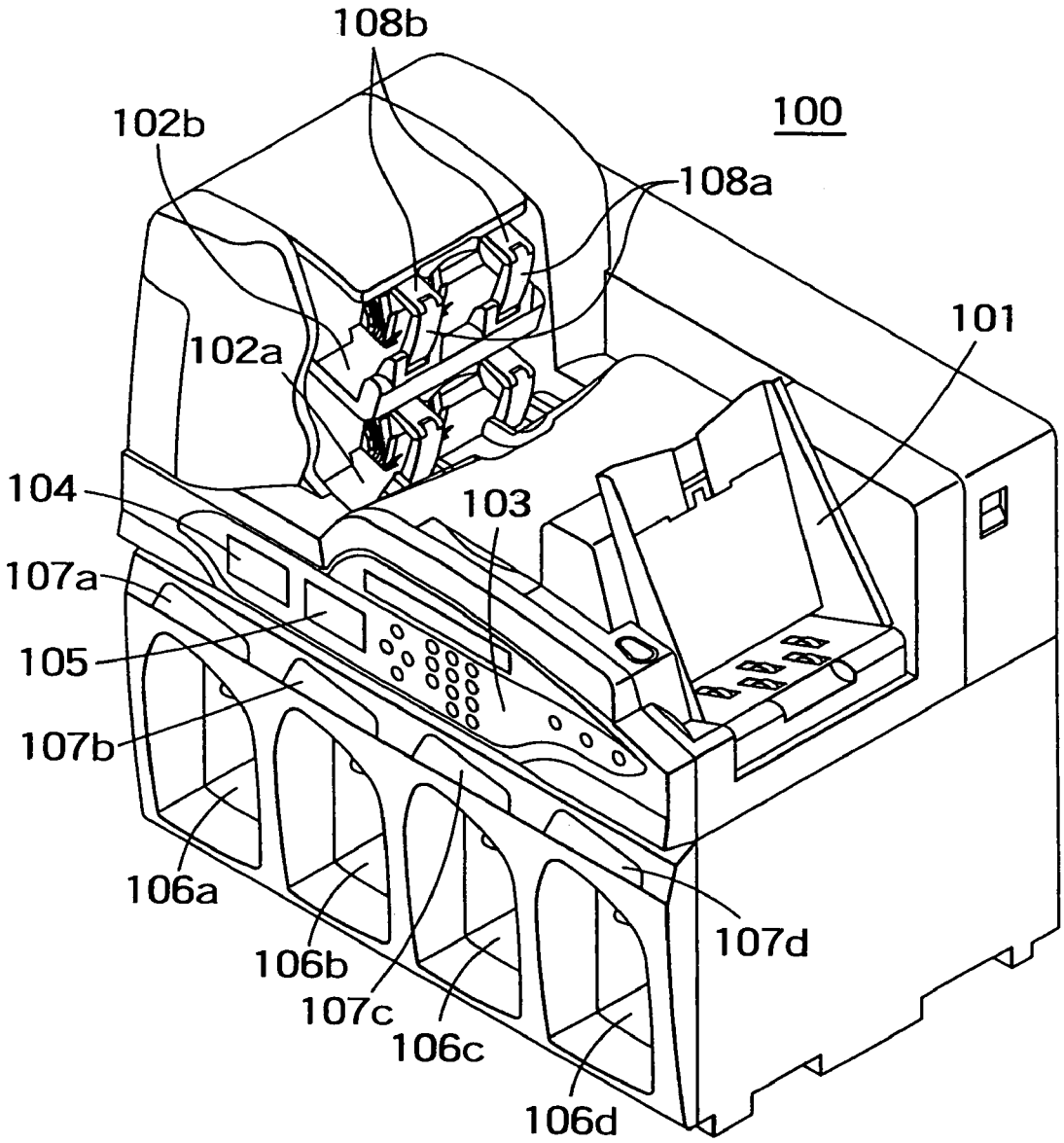
FIG. 1 is a perspective view showing an outline of a banknote processing device 100 according to an embodiment of the present invention.

100 banknote processing device
101 take-in unit
102*a*, 102*b* first and second upper stacking units
1021*a*, 1021*b* first openings
1022*a*, 1022*b* second openings
103 operation unit (designation unit and selection unit)
104 first total display unit
105 second total display unit
106*a* to 106*d* first to fourth lower stacking units
107*a* to 107*d* first to fourth individual display units
108*a*, 108*b* first arm and second arm
111 controller
112 storage unit
113 recognition unit
114 transport path (transport unit)
120 detection unit
121 to 127 sensors

BEST MODES FOR CARRYING OUT THE INVENTION

Embodiments of the present invention will be explained below with reference to the accompanying drawings. The following embodiments are only exemplary and the scope of the invention is not limited thereto.

FIG. 1 is a perspective view showing an outline of a banknote processing device 100 according to an embodiment of the present invention. As shown in FIG. 1, the banknote processing device 100 includes a take-in unit 101, first and second upper stacking units 102*a* and 102*b*, an operation unit 103, a first total display unit 104, a second total display unit 105, first to fourth lower stacking units 106*a* to 106*d*, and first to fourth individual display units 107*a* to 107*d*.

The take-in unit 101 has plural banknotes placed thereon in a stacked manner by an operator and takes in the placed banknotes. The first and second upper stacking units 102*a* and 102*b* eject banknotes that have not been stacked in the first to fourth lower stacking units 106*a* to 106*d* described later. For example, when banknotes taken in by the take-in unit 101 are rejected notes (for example, banknotes that are unrecognizable due to a transport error or counterfeit notes), the first upper stacking unit 102*a* ejects the banknotes. The second upper stacking unit 102*b* ejects banknotes other than those in specific denominations stacked in the first to fourth lower stacking units 106*a* to 106*d*. Each of the first and second upper stacking units 102*a* and 102*b* is provided with a stopper including a pair of arms. The pair of arms includes a first arm 108*a* that has a lower end supported swingably around an axis and extends upward, and a second arm 108*b* that is supported swingably around an axis at a distal end of the first arm 108*a* and extends horizontally. The pair of arms receives the ejected banknotes to prevent the banknotes from falling out of the device, and is movable in two directions (upward and rightward in which the take-in unit 101 is located) to facilitate taking out of the ejected banknotes. The first to fourth lower stacking units 106*a* to 106*d* each include an opening that opens on a front side thereof to facilitate taking out of the ejected banknotes.

The first and second upper stacking units 102*a* and 102*b* include first openings 1021*a* and 1021*b* that open in the same direction as those of the first to fourth lower stacking units, and second openings 1022*a* and 1022*b* that open in a direction toward the take-in unit 101, respectively. The first openings 1021*a* and 1021*b* are provided to facilitate taking out of the banknotes like the openings of the first to fourth lower stacking units 106*a* to 106*d*. The second openings 1022*a* and 1022*b* are provided not only to facilitate taking out of the banknotes but also to facilitate placing again of the taken-out banknotes on the take-in unit 101.

The operation unit 103 includes an input key for receiving an instruction from the operator. In the present embodiment, the operation unit 103 performs designation of each mode (an orientation mode, a specified-four-denomination batch mode, a specified-two-denomination batch mode, a specific-denomination judgment mode, and the like, described later) and selection of a kind of banknotes to be stacked in the second upper stacking unit 102*b*. The first total display unit 104 and the second total display unit 105 display predetermined data (graphic data, for example).

The first to fourth lower stacking units 106*a* to 106*d* sort the banknotes taken in by the take-in unit 101 into attributes (denominations, orientations, face/back, fitness, oldness/newness, for example) of the banknotes, and stack the sorted banknotes. The first to fourth individual display units 107*a* to 107*d* are provided correspondingly to the first to fourth lower stacking units 106*a* to 106*d*, and display the number of stacked banknotes in the corresponding first to fourth lower stacking units 106*a* to 106*d* and the like.

That is, the banknote processing device 100 includes the two upper stacking units 102*a* and 102*b* and the four lower stacking units 106*a* to 106*d*. At least one of the two upper stacking units 102*a* and 102*b* is used to stack rejected notes. The four lower stacking units 106*a* to 106*d* are provided correspondingly to a number required when banknotes of the same denomination are sorted according to orientations in which the banknotes are placed on the take-in unit 101 (orientations A to D described later). More than four stacking units are rarely needed even when the banknotes are sorted according to other criteria. Therefore, the two upper stacking units 102*a* and 102*b* and the four lower stacking units 106*a* to 106*d* is a minimum configuration in the present embodiment.

Figure 10:
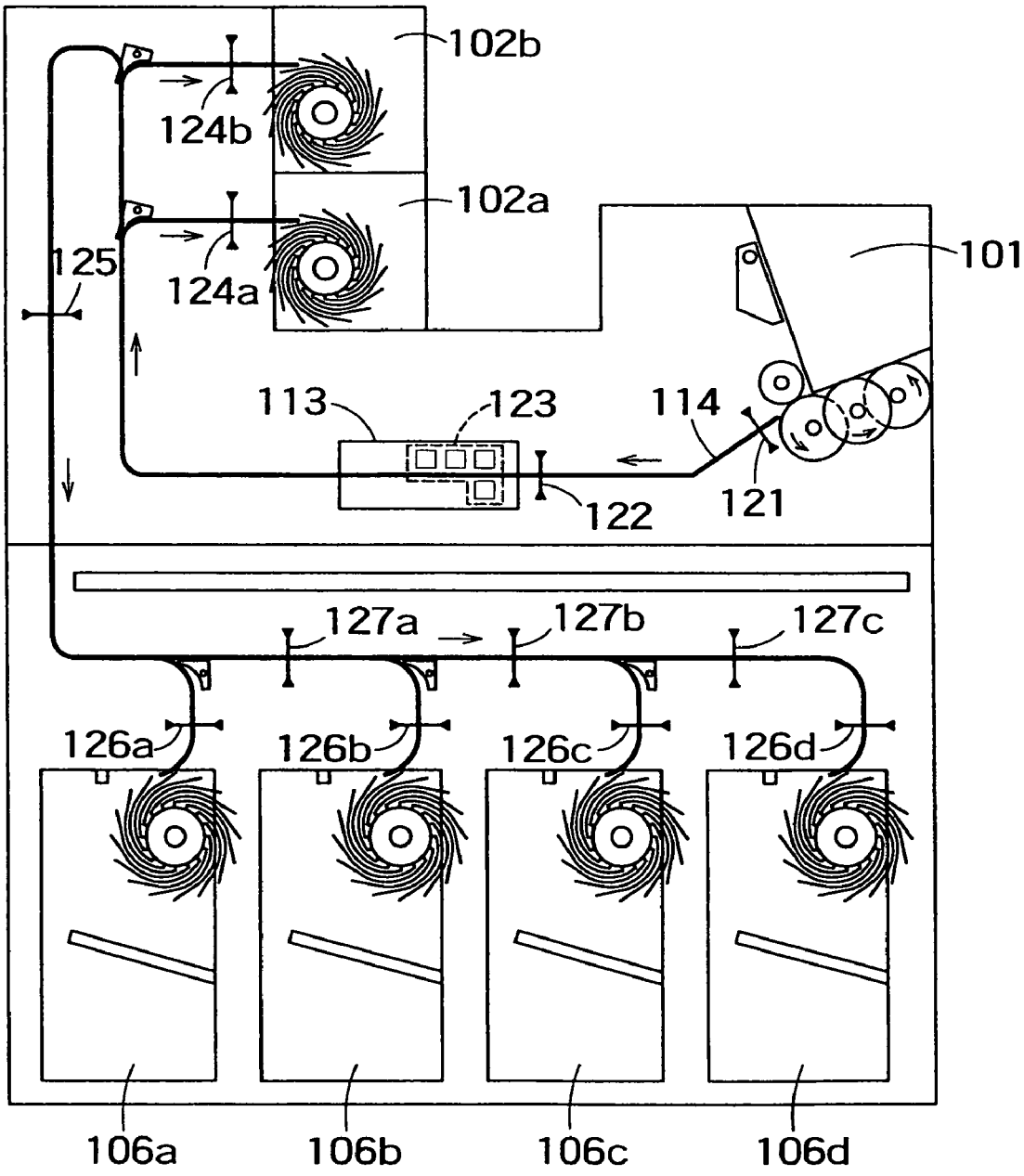
FIG. 10 is a schematic diagram showing an outline of an internal configuration of the banknote processing device 100 according to an embodiment of the present invention.

FIG. 10 is a schematic diagram showing an outline of an internal configuration of the banknote processing device 100 according to the embodiment. As shown in FIG. 10, a transport path (transport unit) 114 for stacking banknotes placed on the take-in unit 101 in the first to fourth lower stacking units 106*a* to 106*d* is provided inside. The transport unit 114 is usually a combination of belt transport mechanisms. Various sensors 121 to 127 are provided along the transport unit 114. The sensor 121 provided on the side of an outlet of the take-in unit 101 and the sensor 122 provided on the side of an inlet of a recognition unit 113 described later (a detection unit 120) detect that banknotes are assuredly taken in and that there is no double feeding of banknotes, respectively. The recognition unit 113 provided in the transport unit 114 is configured by a sensor group 123 including various sensors, and detects fitness, authentication, denominations, orientations, face/back, and the like of the banknotes taken in by the take-in unit 101. For example, the sensor group 123 is a transparent sensor that recognizes denominations or authentication of the banknotes based on light transmittance, a color sensor that recognizes denominations, fitness, or orientations, a thickness sensor that recognizes thicknesses of banknotes, a magnetic line sensor that recognizes denominations, an ultraviolet (UV) sensor that recognizes authentication, a laser sensor that recognizes authentication, or a tracking sensor that recognizes whether the banknotes have passed through an outlet and an inlet of the recognition unit 113.

Figure 2:
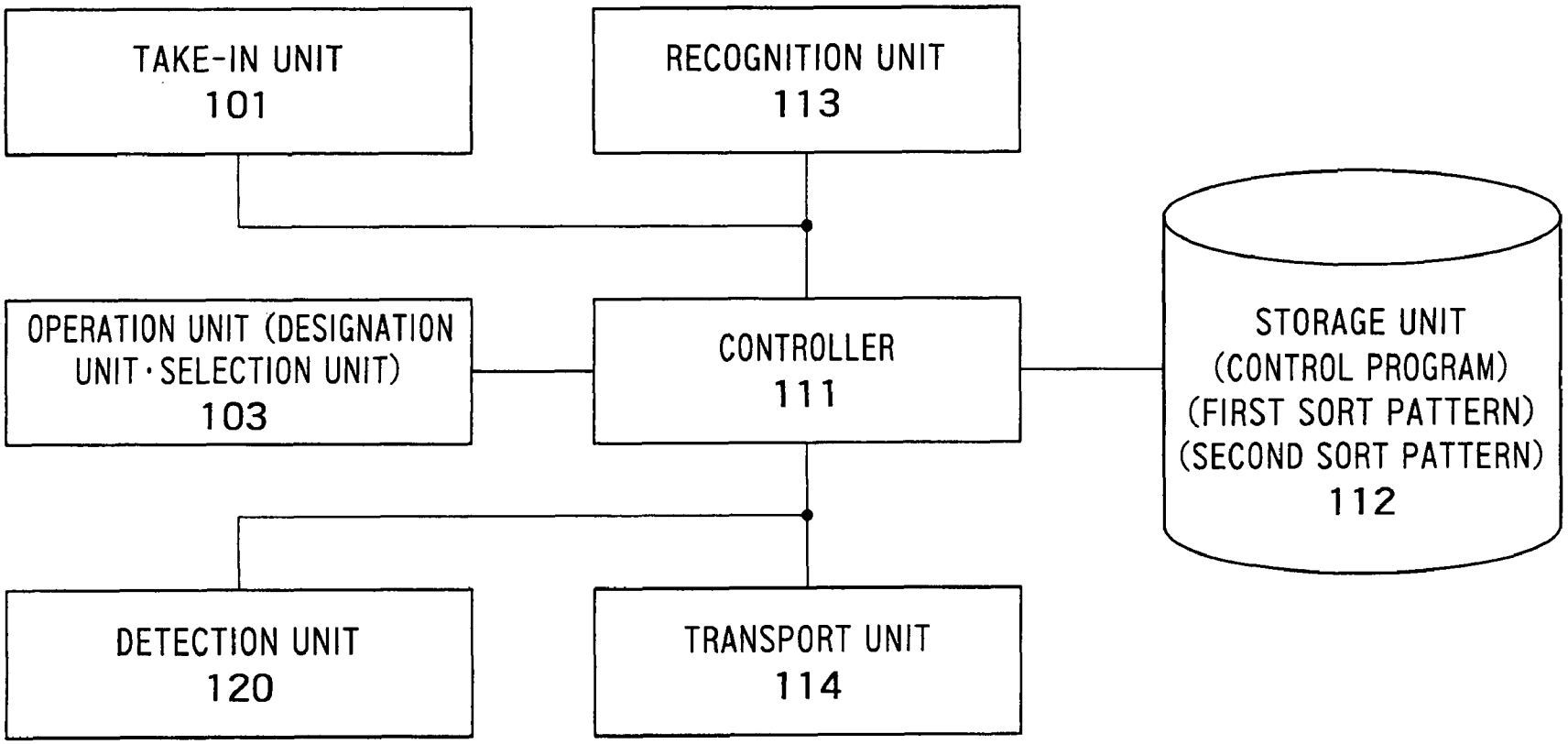
FIG. 2 is a block diagram showing a configuration of the banknote processing device 100 according to an embodiment of the present invention.

FIG. 2 is a block diagram showing a configuration of the banknote processing device 100 according to the embodiment. As shown in FIG. 2, the banknote processing device 100 includes a controller 111 that controls the take-in unit 101, the operation unit (designation unit and selection unit) 103, the recognition unit 113, the transport unit 114, and the detection unit 120, and a storage unit 112.

The controller 111 controls the take-in unit 101, the operation unit 103, the recognition unit 113, the transport unit 114, and the detection unit 120 based on a control program stored in the storage unit 112. The storage unit 112 stores therein a first sort pattern and a second sort pattern described later, in addition to the control program for the controller 111. For example, the controller 111 is a processor such as a CPU, and the storage unit 112 is a rewritable storage medium such as a RAM. Data stored in the storage unit 112 are not limited to the control program, the first sort pattern, and the second sort pattern.

The take-in unit 101 takes in the banknotes placed thereon as described above. The operation unit 103 operates as the designation unit that receives details of designation by the operator related to a batch mode (for example, designation of the batch mode, designation of a predetermined number of banknotes for each of the first to fourth lower stacking units 106*a* to 106*d*, designation of sorting criteria for the first to fourth lower stacking units 106*a* to 106*d*). The operation unit 103 also operates as the selection unit that selects one of the first and second sort patterns stored in the storage unit 112, as a sort pattern to be used. The recognition unit 113 recognizes attributes of the banknotes taken in by the take-in unit 101 and detects an error when the denominations cannot be recognized (denomination recognition error) and an error when the authentication cannot be recognized (authentication recognition error). The transport unit 114 transports the banknotes taken in by the take-in unit 101 to one of the first and second upper stacking units 102*a* and 102*b* and the first to fourth lower stacking units 106*a* to 106*d* based on a result of the recognition by the recognition unit 113. The detection unit 120 detects a transport error in the transport process performed by the transport unit 114 by means of the sensors 121 and 122. For example, when no banknote is taken in by the take-in unit 101, the detection unit 120 judges that the transport error occurs based on a result of the detection by the sensor 121.

Figure 11:
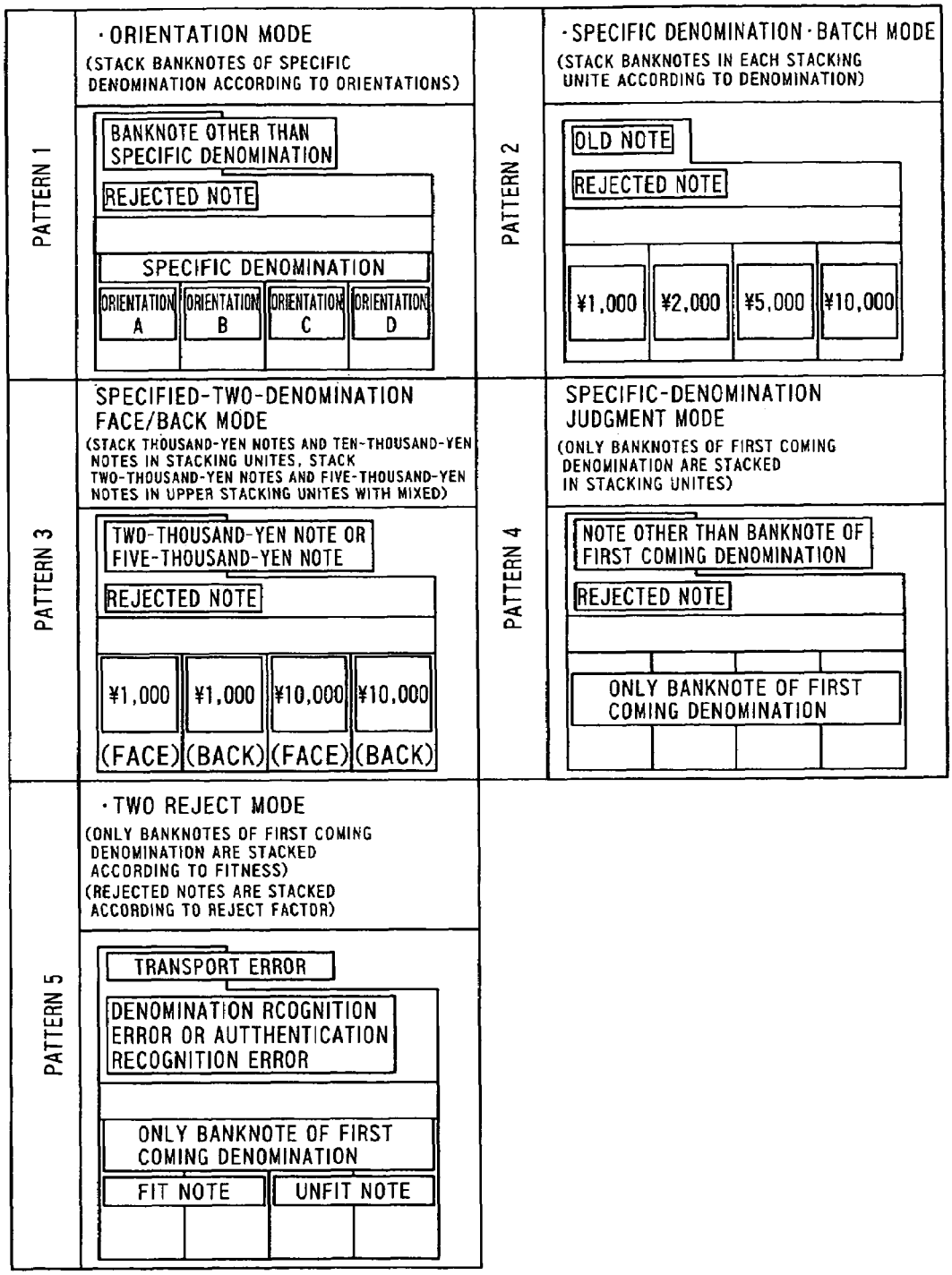
FIG. 11 is a schematic diagram showing sort patterns for the banknotes to be staked in the first and second upper stacking units 102*a* and 102*b* and the first to fourth lower stacking units 106*a* to 106*d*.

FIG. 11 is a schematic diagram showing sort patterns for the banknotes to be staked in the first and second upper stacking units 102*a* and 102*b* and the first to fourth lower stacking units 106*a* to 106*d*. Images shown in the schematic diagram can be displayed by the first and second total display units 104 and 105.

A pattern 1 is a sort pattern for an orientation mode described later (see FIG. 4). In the pattern 1, banknotes of a first coming denomination are stacked in the first to fourth lower stacking units 106*a* to 106*d* according to orientations (orientations A to D) of banknotes.

A pattern 2 is a sort pattern for a specific denomination batch mode described later (see FIG. 5). In the pattern 2, rejected notes are stacked in the first upper stacking unit 102*a*, old notes are stacked in the second upper stacking unit 102*b*, thousand-yen notes are stacked in the first lower stacking unit 106*a*, two-thousand-yen notes are in the second lower stacking unit 106*b*, five-thousand-yen notes are stacked in the third lower stacking unit 106*c*, and ten-thousand-yen notes are stacked in the fourth lower stacking units 106*d*.

A pattern 3 is a sort pattern for a specified-two-denomination face/back mode described later (see FIG. 6). In the pattern 3, rejected notes are stacked in the first upper stacking unit 102*a*, two or five-thousand-yen notes are stacked in the second upper stacking unit 102*b*, and thousand-yen notes and ten-thousand-yen notes are stacked in the first to fourth lower stacking units 106*a* to 106*d* according to whether the banknotes are face-up or face-down (back).

A pattern 4 is a sort pattern for a specific-denomination judgment mode described later (see FIG. 7). In the pattern 4, banknotes of a first coming denomination (banknotes of a denomination first judged as other than rejected notes) are stacked in the first to fourth lower stacking units 106*a* to 106*d*.

Figure 8:
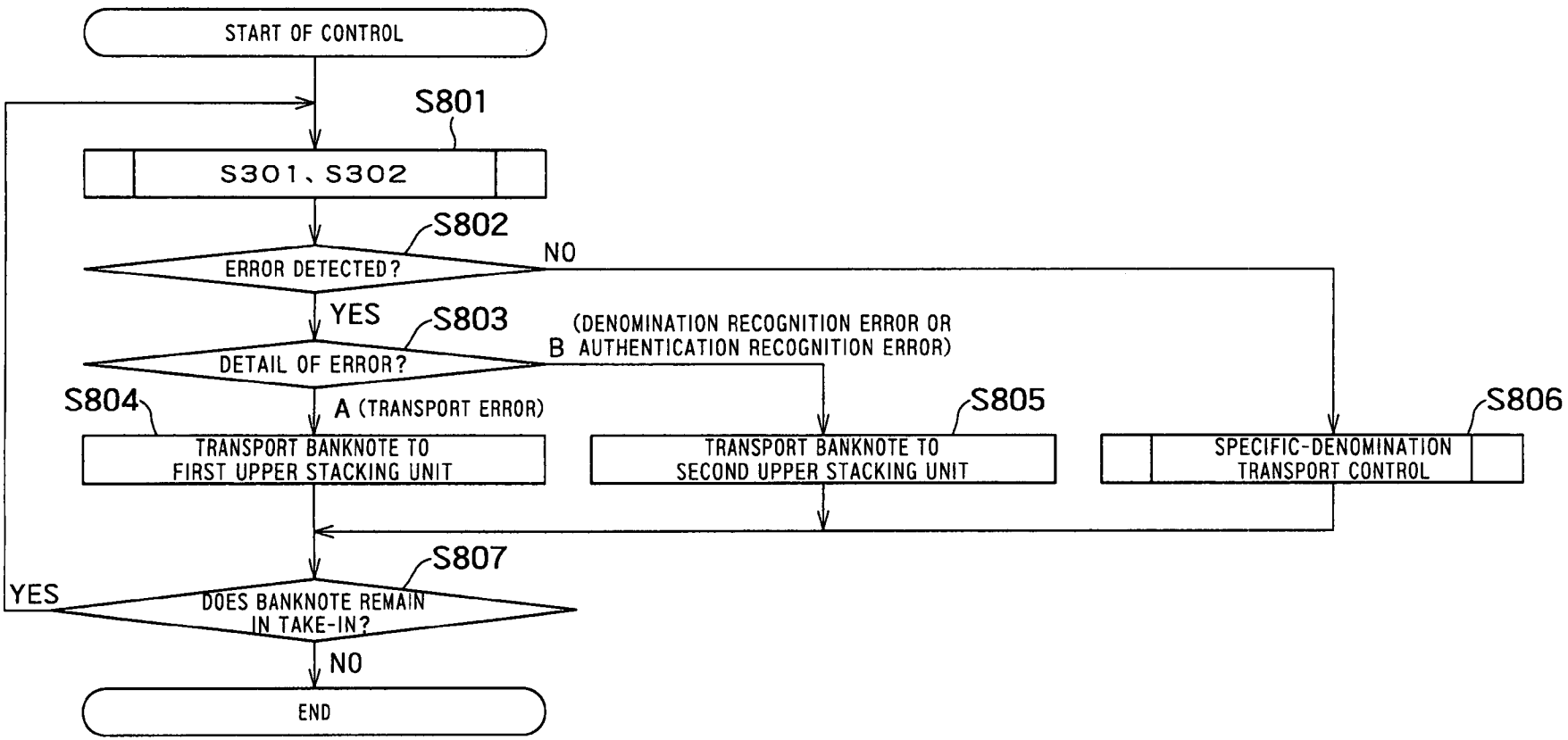
FIG. 8 is a flowchart showing a control according to the fifth embodiment of the present invention.

A pattern 5 is a sort pattern in which rejected notes are stacked in the first and second upper stacking units 102*a* and 102*b* according to factors of errors (see FIG. 8).

First Embodiment

Figure 3:
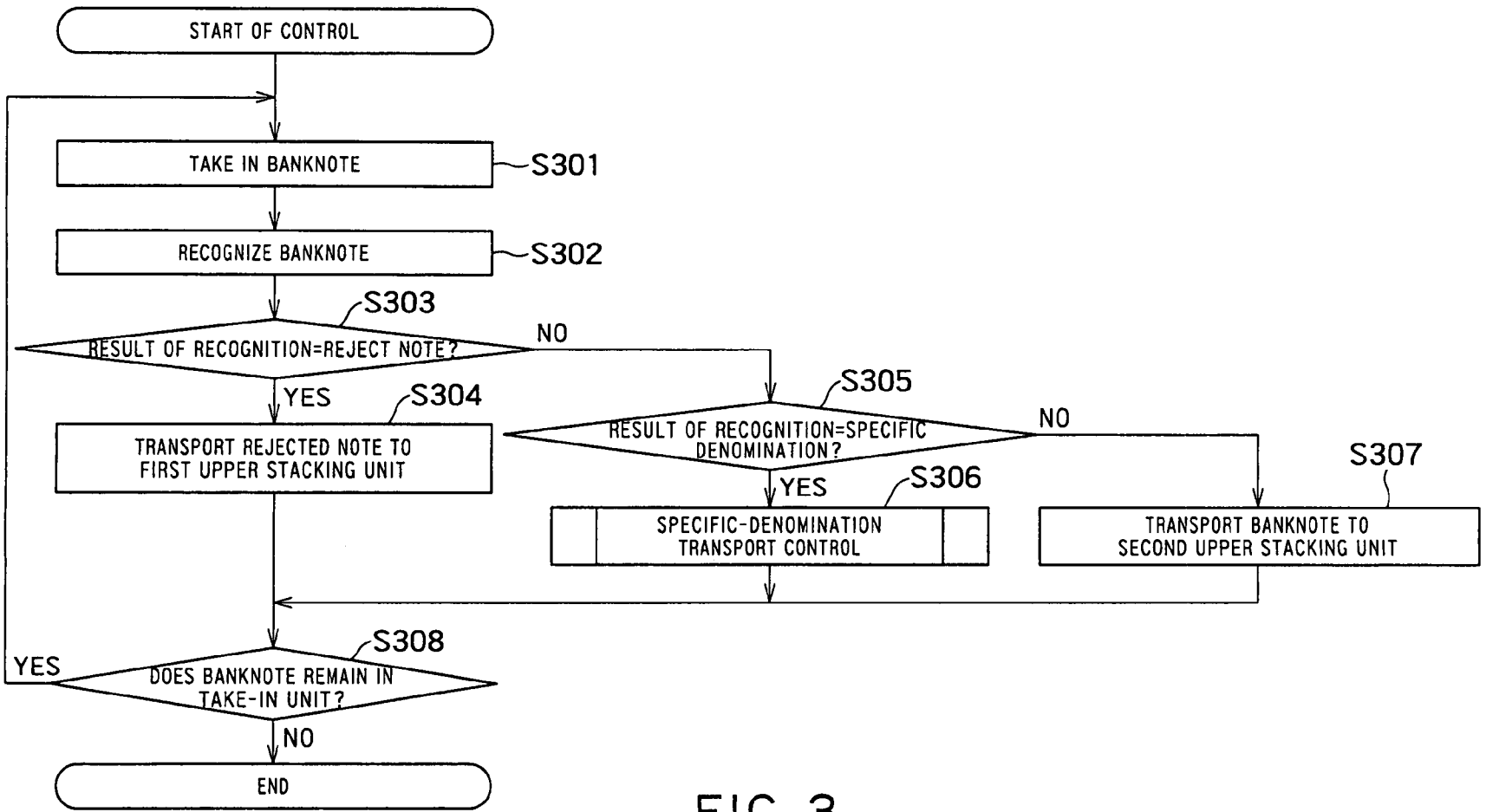
FIG. 3 is a flowchart showing a control according to the first embodiment of the present invention.

A first embodiment of the present invention is explained next. FIG. 3 is a flowchart showing a control according to the first embodiment.

The controller 111 first controls the take-in unit 101 to take in the banknotes placed thereon one by one (S301). The controller 111 then controls the recognition unit 113 to recognize an attribute of the banknote taken in by the take-in unit 101 (S302). When a result of the recognition at S302 is a rejected note (S303-Yes), the controller 111 controls the transport unit 114 to transport the rejected note to the first upper stacking unit 102*a* (S304).

When the result of the recognition at S302 is not a rejected note (S303-No) and is a specific denomination previously designated (S305-Yes), a specific-denomination transport control described later (see FIGS. 4 to 6) is performed (S306). The judgment at S305 is performed based on the specific denomination designated by the operator through the operation unit 103. When the result is not the specific denomination (S305-No), the controller 111 controls the transport unit 114 to transport the banknote to the second upper stacking unit 102*b* (S307).

When the banknotes remain in the take-in unit 101 after any of S304, S306, and S307 is completed (S308-Yes), the control returns to S301. When no banknote remains in the take-in unit 101 after any of S304, S306, and S307 is completed (S308-No), the control is ended.

Figure 4B:
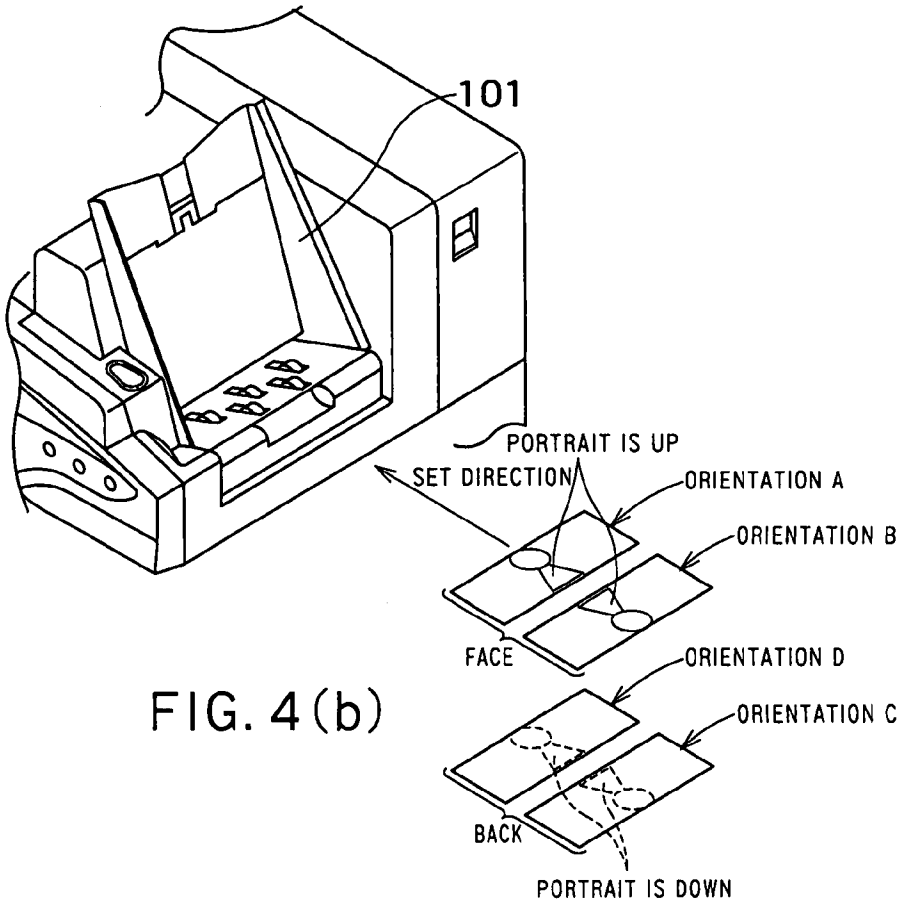
FIG. 4(*a*) is a flowchart showing the specific-denomination transport control according to the first embodiment of the present invention.
Figure 4A:
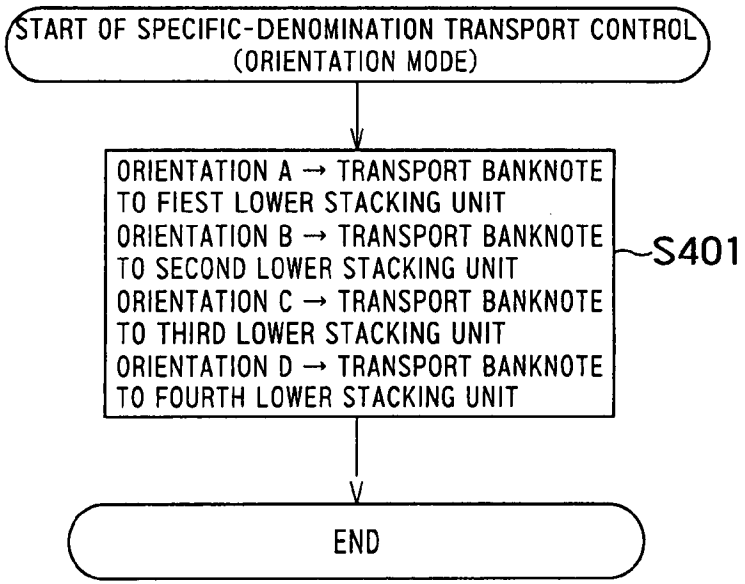

FIG. 4(*a*) is a flowchart showing the specific-denomination transport control according to the first embodiment. The specific-denomination transport control according to the first embodiment is performed when the orientation mode is designated.

The controller 111 controls the transport unit 114 to transport the banknote to one of the first to fourth lower stacking units 106*a* to 106*d* according to an orientation in the result of the recognition at S302 in FIG. 3 (according to an orientation of the banknote placed on the take-in unit 101) (S501). Specifically, a banknote in the orientation A is transported to the first lower stacking unit 106*a*, a banknote in the orientation B is transported to the second lower stacking unit 106*b*, a banknote in the orientation C is transported to the third lower stacking unit 106*c*, and a banknote in the orientation D is transported to the fourth lower stacking unit 106*d*.

FIG. 4(*b*) is an explanatory diagram showing orientations of the banknotes. As shown in FIG. 4(*b*), an orientation of a banknote is determined as any of four orientations (orientations A to D) according to a combination of an orientation of a portrait and face/back of the banknote when the banknote is placed on the take-in unit 101. Specifically, an orientation in which the portrait is up and the banknote is taken in from the head side of the portrait is the orientation A, an orientation in which the portrait is up and the banknote is taken in from the side opposite to the head is the orientation B, an orientation in which the portrait is down and the banknote is taken in from the side opposite to the head of the portrait is the orientation C, and an orientation in which the portrait is down and the banknote is taken in from the head side is the orientation D. The orientations in which the portrait is up (orientations A and B) are face-up and the orientations in which the portrait is down (orientations C and D) are face-down (back). The orientation of the portrait and the face/back of the banknote when the banknote is placed on the take-in unit 101 are recognized by the recognition unit 113.

According to the first embodiment, the banknote processing device 100 includes the two upper stacking units 102*a* and 102*b* and the four lower staking units 106*a* to 106*d*. Therefore, the size of the banknote processing device is minimized.

Banknotes of a specific denomination are stacked in the different orientations into the first to fourth lower stacking units 106*a* to 106*d* according to the orientations of the banknotes placed on the take-in unit 101, and banknotes other than the specific denomination are stacked in the second upper stacking unit 102*b* with the denominations mixed. Therefore, the number of the banknote sorting processes can be reduced.

Further, the first to fourth lower stacking units 106*a* to 106*d* and the second upper stacking unit 102*b* are separately provided in the lower and upper portions of the banknote processing device 100, respectively. Therefore, a distinction therebetween can be clearly shown to the operator.

Second Embodiment

A second embodiment of the present invention is explained next. In the first embodiment, the case where banknotes of one specific denomination are sorted and stacked according to the orientations of the banknotes placed on the take-in unit 101 has been explained. In the second embodiment, a case where banknotes of four specific denominations are sorted and stacked according to the denominations, and taking-in of the banknotes is temporarily stopped when banknotes of any of the denominations reaches a predetermined number (so-called batch process) is explained. Like explanations as those in the first embodiment will be omitted.

Figure 5:
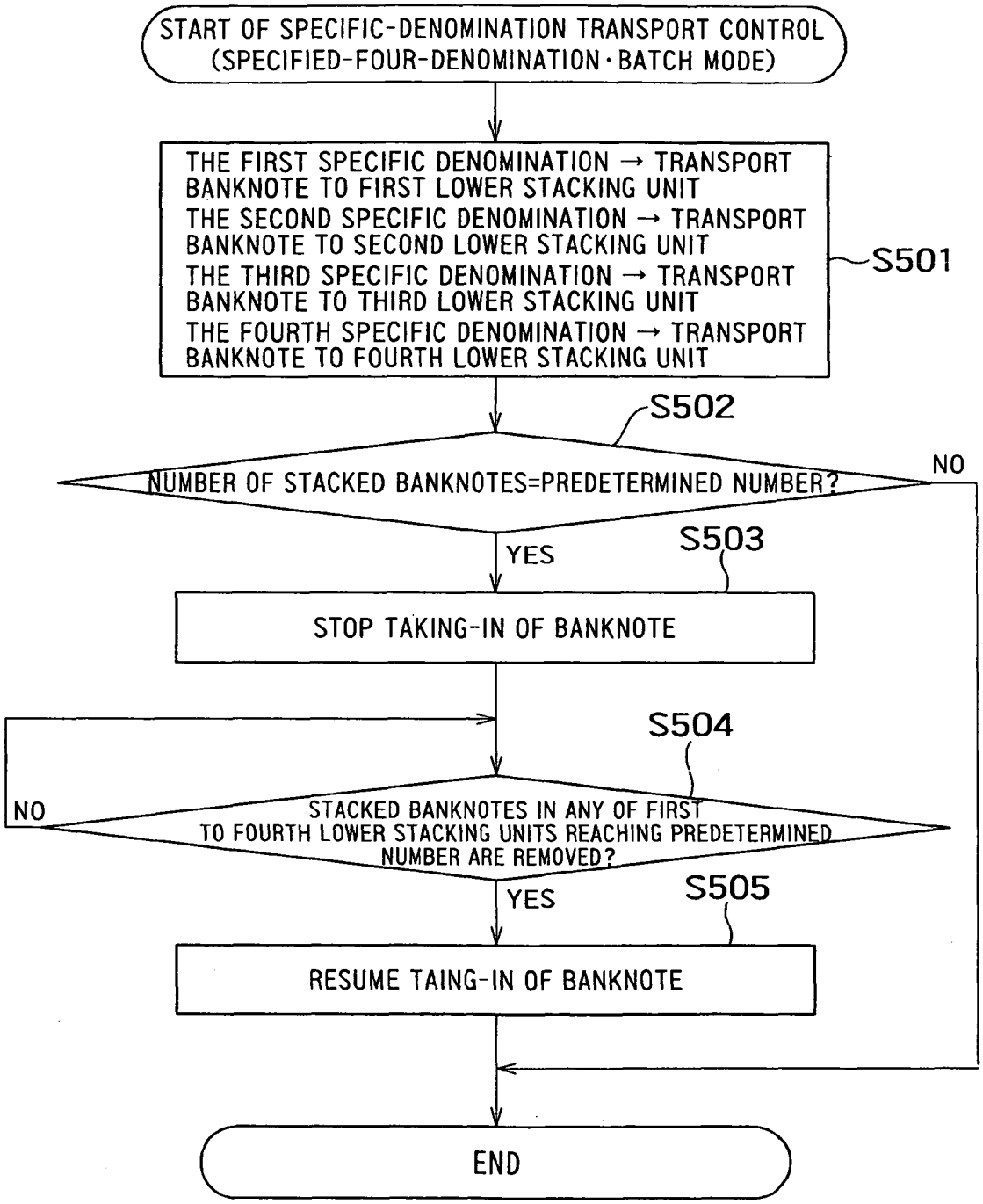
FIG. 5 is a flowchart showing a specific-denomination transport control according to the second embodiment of the present invention.

FIG. 5 is a flowchart showing a specific-denomination transport control according to the second embodiment. The specific-denomination transport control according to the second embodiment is performed when the specific-four-denomination batch mode is designated.

The controller 111 first controls the transport unit 114 to transport a banknote to one of the first to fourth lower stacking units 106*a* to 106*d* according to a denomination in the result of the recognition at S302 in FIG. 3 (S501). Specifically, a banknote of a first specific denomination is transported to the first lower stacking unit 106*a*, a banknote of a second specific denomination is transported to the second lower stacking unit 106*b*, a banknote of a third specific denomination is transported to the third lower stacking unit 106*c*, and a banknote of a fourth specific denomination is transported to the fourth lower stacking unit 106*d*.

When the number of stacked banknotes in any of the first to fourth lower stacking units 106*a* to 106*d* reaches a predetermined number (S502-Yes), the controller 111 controls the take-in unit 101 to temporarily stop taking-in of the banknotes (S503). After the stacked banknotes in any of the first to fourth lower stacking units 106*a* to 106*d* reaching the predetermined number at S502 are removed (S504-Yes), the controller 111 controls the take-in unit 101 to resume taking-in of the banknotes (S505).

When the number of stacked banknotes in none of the first to fourth lower staking units 106*a* to 106*d* reaches the predetermined number (S502-No), the specific-denomination transport control is ended.

According to the second embodiment, banknotes of the specific denominations are sorted and stacked in the first to fourth lower stacking units 106*a* to 106*d* according to the denominations, and banknotes other than the specific denominations are stacked in the second upper stacking unit 102*b* with the denominations mixed. Therefore, the same effect as that in the first embodiment can be obtained also when the batch process of sorting the banknotes of the same denominations into a predetermined number is performed.

Third Embodiment

A third embodiment of the present invention is explained next. In the first embodiment, the case where the banknotes of one specific denomination are sorted and stacked according to orientations of the banknotes placed on the take-in unit 101 has been explained. A case where banknotes of two specific denominations are sorted and stacked is explained in the third embodiment. Like explanations as those in the first and second embodiments will be omitted.

Figure 6:
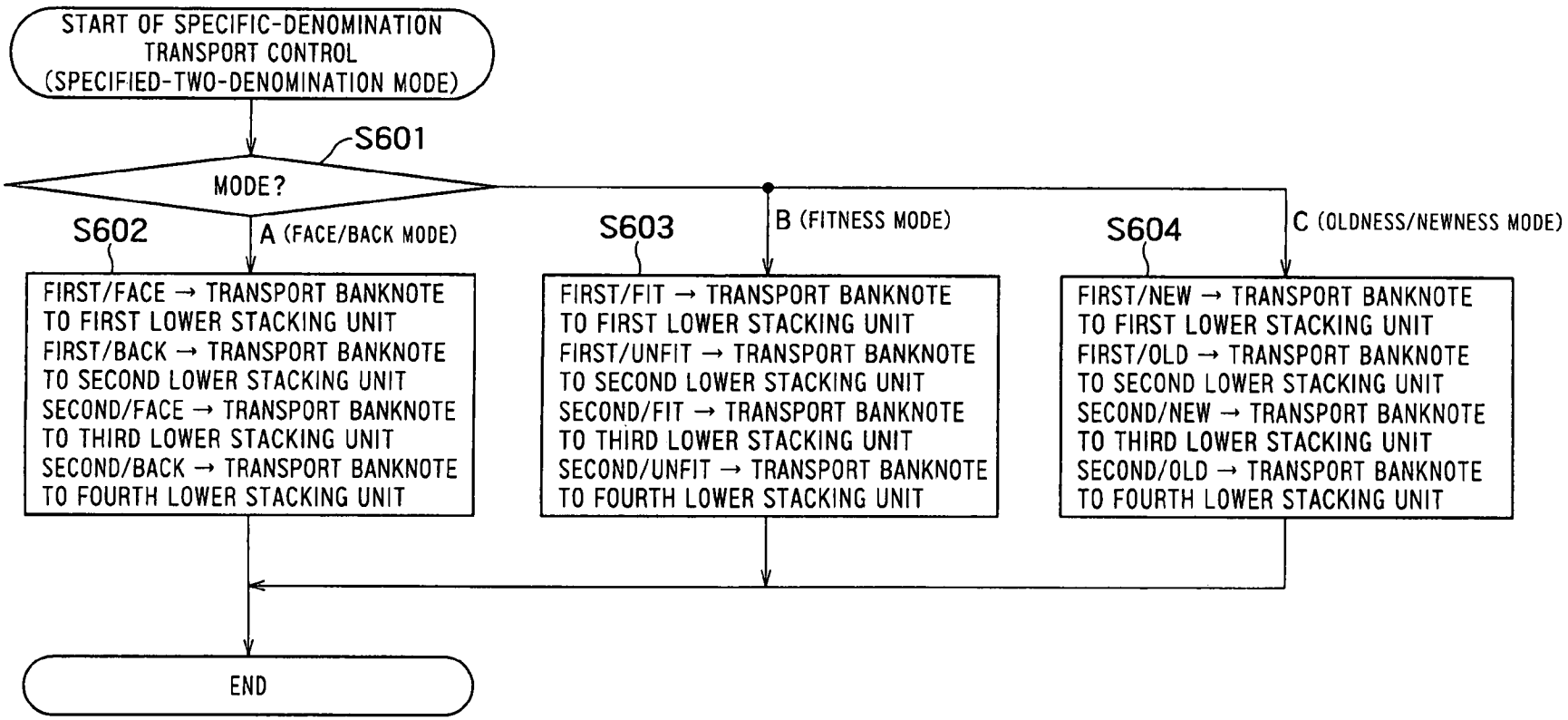
FIG. 6 is a flowchart showing a specific-denomination transport control according to the third embodiment of the present invention.

FIG. 6 is a flowchart showing a specific-denomination transport control according to the third embodiment. The specific-denomination transport control according to the third embodiment is performed when the specific-two-denomination mode is designated.

The controller 111 first judges which mode is designated through the operation unit 103 (S601). When the face/back mode is designated (S601-A), the controller 111 controls the transport unit 114 to transport the banknote to one of the first to fourth lower stacking unit 106*a* to 106*d* according to the denomination and face/back in the result of the recognition at S302 in FIG. 3 (S602). Specifically, a banknote of a first specific denomination facing up is transported to the first lower stacking unit 106*a*, a banknote of the first specific denomination facing down is transported to the second lower stacking unit 106*b*, a banknote of a second specific denomination facing up is transported to the third lower stacking unit 106*c*, and a banknote of the second specific denomination facing down is transported to the fourth lower stacking unit 106*d*.

When the fitness mode is designated (S601-B), the controller 111 controls the transport unit 114 to transport the banknote to one of the first to fourth lower stacking units 106*a* to 106*d* according to the denomination and fitness in the result of the recognition at S302 in FIG. 3 (S603). Specifically, a fit note of the first specific denomination is transported to the first lower stacking unit 106*a*, an unfit note of the first specific denomination is transported to the second lower stacking unit 106*b*, a fit note of the second specific denomination is transported to the third lower stacking unit 106*c*, and an unfit note of the second specific denomination is transported to the fourth lower stacking unit 106*d*.

When the oldness/newness mode is designated (S601-C), the controller 111 controls the transport unit 114 to transport the banknote to one of the first to fourth lower stacking units 106*a* to 106*d* according to the denomination and oldness/newness in the result of the recognition at S302 in FIG. 3 (S604). Specifically, a new note of the first specific denomination is transported to the first lower stacking units 106*a*, an old note of the first specific denomination is transported to the second lower stacking unit 106*b*, a new note of the second specific denomination is transported to the third lower stacking unit 106*c*, and an old note of the second specific denomination is transported to the fourth lower stacking unit 106*d*. Upon completion of any of S602 to S604, the specific-denomination transport control is ended.

According to the third embodiment, in addition to the same effects as those of the first and second embodiments, banknotes of the two specific denominations are sorted and stacked in the first to fourth lower stacking units 106*a* to 106*d* according to the face/back, the fitness, and the oldness/newness, and banknotes other than the specific denominations are stacked in the second upper stacking unit 102*b* with the denominations mixed. Therefore, the same effect as that of the first embodiment can be obtained also when the banknotes of the two specific denominations are sorted in a lump.

Fourth Embodiment

A fourth embodiment of the present invention is explained. In the first embodiment, the case where the specific denomination judgment is performed based on the denomination previously designated by the operation unit 103 has been explained. In the fourth embodiment, a case where specific denominations are judged automatically is explained. Like explanations as those in the first to third embodiments will be omitted.

Figure 7:
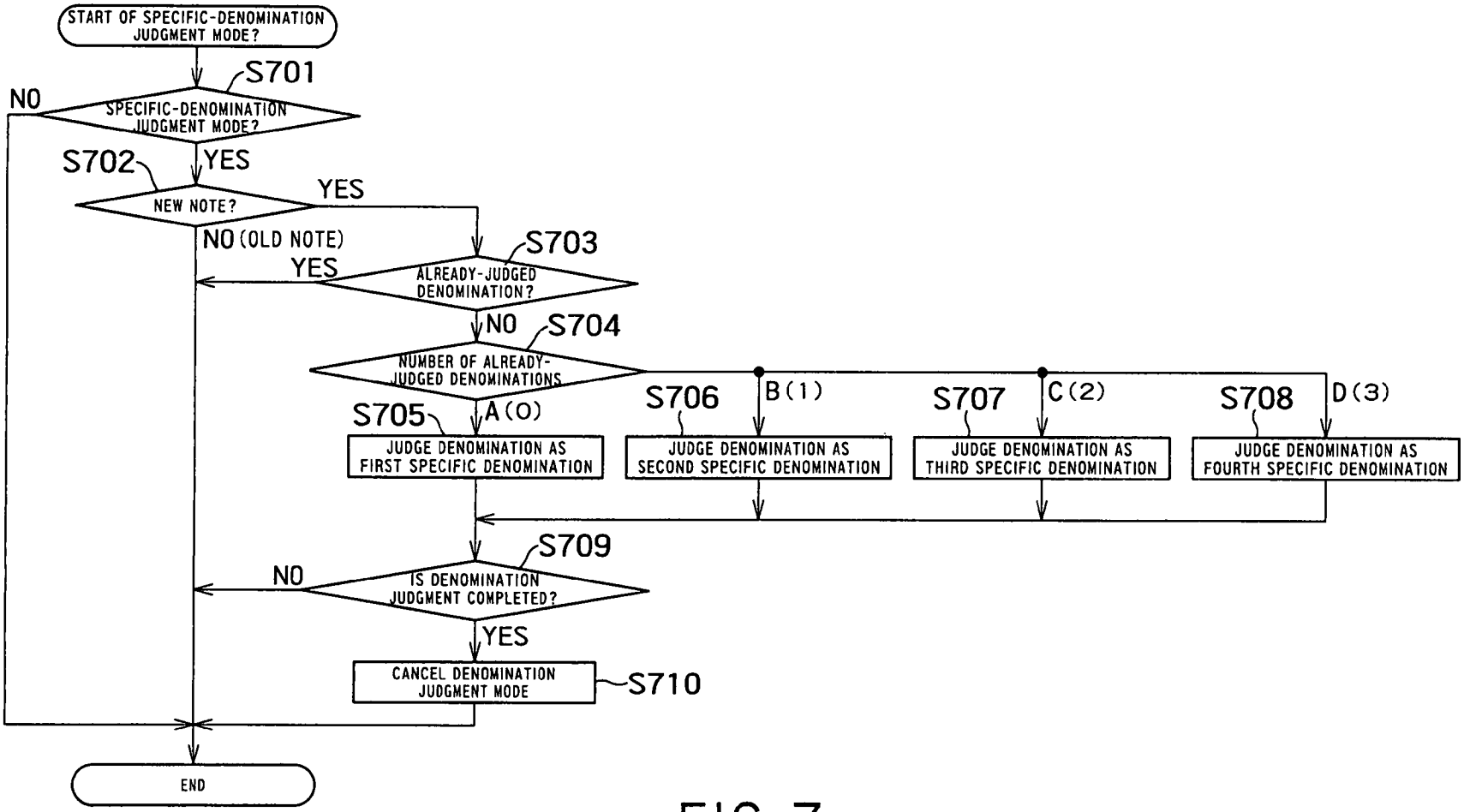
FIG. 7 is a flowchart showing a specific denomination judgment according to the fourth embodiment of the present invention.

FIG. 7 is a flowchart showing a specific denomination judgment according to the fourth embodiment. The specific denomination judgment according to the fourth embodiment is a process performed when the specific-denomination judgment mode is designated, and is performed when the result of the recognition at S303 in FIG. 3 is not a rejected note (S303-No), for example.

The controller 111 first judges whether the specific-denomination judgment mode is designated (S701). Specifically, the controller 111 judges that the specific-denomination judgment mode is designated when the specific-denomination judgment mode is designated through the operation unit 103 and when a specific-denomination-judgment mode cancel process (S710) described later is not performed (S701-Yes).

When the specific-denomination judgment mode is designated (S701-Yes), the controller 111 judges whether the recognition result at S302 is a new note (S702). When judging at S702 that the result is a new note (S702-Yes), the controller 111 judges whether a denomination recognized at S302 has been already judged as a specific denomination (S703).

When judging at S703 that the denomination has not been already judged (S703-No), the controller 111 judges the denomination as a specific denomination according to the number of already-judged denominations (S704 and S705 to S708). Specifically, when the number of already-judged denominations is zero, the controller 111 judges the denomination as a first specific denomination (S704-A and S705). The controller 111 judges the denomination as a second specific denomination when the number of already-judged denominations is one (S704-B and S706), as a third specific denomination when the number of already-judged denominations is two (S704-C and S707), and as a fourth specific denomination when the number of already-judged denominations is three (S704-D and S708).

When the denomination judgment is completed (S709-Yes), the controller 111 cancels the denomination judgment mode (S710). The judgment at S709 is performed based on whether the number of denominations to be judged, which is designated by the operator through the operation unit 103, is equal to the number of already-judged denominations.

Meanwhile, when the specific-denomination judgment mode is not designated (S701-No), when the recognition result at S302 is an old note (S702-No), when it is judged at S703 that the denomination has been already judged (S703-Yes), when it is judged at S709 that the denomination judgment is completed (S709-No), and after S710 is finished, the controller 111 ends the specific denomination judgment.

According to the fourth embodiment, in addition to the same effects as those of the first to third embodiments, the specific denominations are judged in the order of new notes taken in by the take-in unit 101. Therefore, it is unnecessary to force the operator into a task of designating the specific denominations.

Fifth Embodiment

A fifth embodiment of the present invention is explained. In the first embodiment, the case where the rejected notes are stacked in the first upper stacking unit 102*a* and the banknotes other than the specific denomination are stacked in the second upper stacking unit 102*b* has been explained. In the fifth embodiment, a case where banknotes that are handled as rejected notes are stacked also in the second upper stacking unit 102*b* is explained. Like explanations as those in the first to fourth embodiments will be omitted.

FIG. 8 is a flowchart showing a control according to the fifth embodiment. The controller 111 first performs the same processes as those at S301 and S302 in FIG. 3 (S801). When an error is detected at S302 (that is, when the banknote is a rejected note) (S802-Yes), the controller 111 controls the transport unit 114 to transport the banknote to either the first upper stacking unit 102*a* or the second upper stacking unit 102*b* according to details of the error (reject factor) (S803). Specifically, when a transport error is detected (S803-A), the banknote is transported to the first upper stacking unit 102*a* (S804). When a denomination recognition error or authentication recognition error is detected (S803-B), the banknote is transported to the second upper stacking unit 102*b* (S805). It is also possible to transport the banknote to the first upper stacking unit 102*a* when the transport error or the denomination recognition error is detected at S803, and to transport the banknote to the second upper stacking unit 102*b* when the authentication recognition error is detected.

When no error is detected at S802 (S802-No), the controller 111 performs the specific-denomination transport control (see FIGS. 4 to 6) as described above (S806).

When the banknotes remain on the take-in unit 101 after completion of any of S804 to S806 (S807-Yes), the control returns to S801. When no banknote remains on the take-in unit 101 after completion of any of S804 to S806 (S807-No), the control is ended.

According to the fifth embodiment, in addition to the same effect as that in the first embodiment, each of the reject factors of the banknotes handled as rejected notes stacked in the two upper stacking units 102*b* can be easily discriminated.

Sixth Embodiment

A sixth embodiment of the present invention is explained. In the first and fifth embodiments, the cases where rejected notes to be stacked in the first and second upper stacking units 102*a* and 102*b* are previously determined have been explained. In the sixth embodiment, a case where banknotes to be stacked in the second upper stacking units 102*b* are selected is explained. Like explanations as those in the first to fifth embodiments will be omitted.

Figure 9:
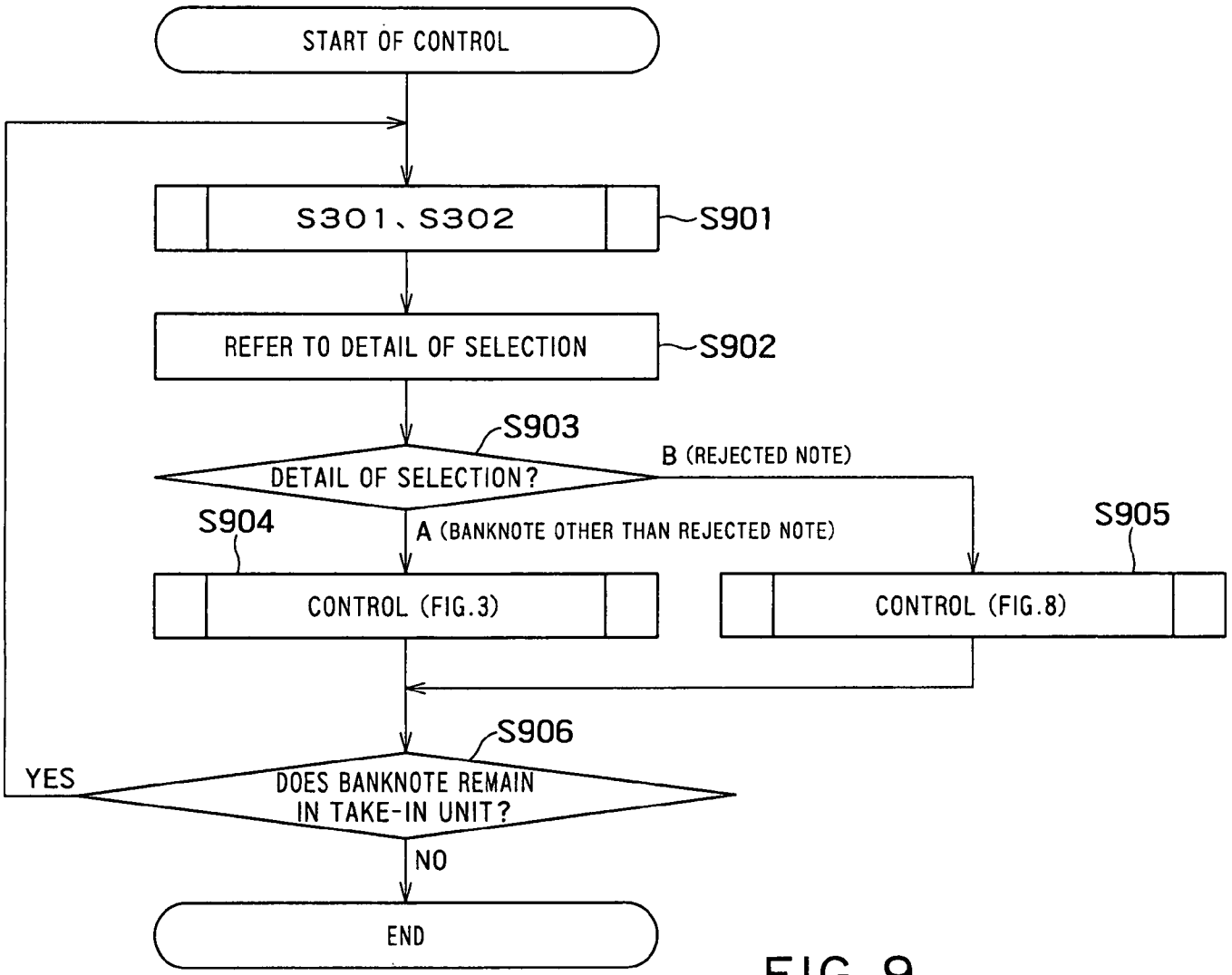
FIG. 9 is a flowchart showing a control according to the sixth embodiment of the present invention.

FIG. 9 is a flowchart showing a control according to the sixth embodiment. The controller 111 first performs the same processes as those at S301 and S302 in FIG. 3 (S901). The controller 111 then refers to details of a selection performed by the operation unit (selection unit) 103 (the first or second sort pattern stored in the storage unit 112) (S902). The first sort pattern is for stacking rejected notes in the second upper stacking unit 102*b*, and the second sort pattern is for stacking banknotes other than the rejected notes in the second upper stacking unit 102*b*. For example, the patterns 1 to 4 in FIG. 11 correspond to the second sort pattern for stacking the banknotes other than the rejected notes in the second upper stacking unit 102*b*, and the pattern 5 corresponds to the first sort pattern for stacking the rejected notes in the second upper stacking unit 102*b*.

When the details of the selection indicate banknotes other than the rejected notes (second sort pattern) (S903-A), the controller 111 performs a control to transport the banknotes other than the rejected notes to the second upper stacking unit 102*b* (S904). The control to transport the banknotes other than the rejected notes is the controls shown in FIGS. 3 to 6.

When the details of the selection indicate rejected notes (first sort pattern) (S903-B), the controller 111 performs a control to transport the rejected notes to the second upper stacking unit 102*b* (S905). The control to transport the rejected notes is the control shown in FIG. 8.

When the banknotes remain on the take-in unit 101 after completion of S904 or S905 (S906-Yes), the control returns to S901. When no banknote remains on the take-in unit 101 after completion of S904 or S905 (S906-No), the control is ended.

According to the sixth embodiment, in addition to the same effects as those of the first to fifth embodiments, rejected notes or banknotes other than the rejected notes are selected as banknotes to be stacked in the second upper stacking unit 102*b*. Therefore, the size of the banknote processing device (the number of stacking units) can be minimized and the minimized number of stacking units can be used depending on applications.

The invention claimed is:

1. A banknote processing device that sorts and stacks plural banknotes, the banknote processing device comprising:

a take-in unit that is provided at an upper position of the banknote processing device and takes in the plural banknotes placed on the take-in unit one by one;

a recognition unit that recognizes the banknote taken in by the take-in unit;

a first upper stacking unit that is provided at an upper position of the banknote processing device;

a second upper stacking unit that is provided adjacent to the first upper stacking unit at the upper position of the banknote processing device;

first to fourth lower stacking units that are arranged in parallel at lower positions of the banknote processing device, each of the first to fourth lower stacking units including an opening that opens on a front side thereof;

a transport unit that transports the banknote taken in by the take-in unit to one of the first and second upper stacking units and the first to fourth lower stacking units; and a controller that controls the transport unit to transport at least one of the banknotes to the first upper stacking unit when recognition results obtained by the recognition unit for the banknotes are rejected notes, to transport at least one of the banknotes to one of the first to fourth lower stacking units when the recognition results obtained by the recognition unit for the banknotes are not rejected but of the at least one specific denomination, and to transport at least one of banknotes to the second upper stacking unit in a denomination-mixed manner when the recognition results obtained by the recognition unit for the banknotes are not rejected notes and not of the at least one specific denomination.

2. The banknote processing device according to claim 1, wherein, when the recognition result obtained by the recognition unit for the banknote is the specific denomination, the controller controls the transport unit to transport the banknote to one of the first to fourth lower stacking units according to a previously determined number of banknotes to be stacked.

3. The banknote processing device according to claim 2, wherein, when the recognition result obtained by the recognition unit for the banknote is not a rejected note, the controller judges a denomination first recognized by the recognition unit as the specific denomination.

4. A banknote processing device according to claim 1, further comprising a detection unit that detects a transport error in the transport unit; wherein the controller controls the transport unit to transport the banknote to the first upper stacking unit when the transport error is detected for the banknote by the detection unit, and to transport the banknote to the second upper stacking unit when a denomination recognition error or an authentication recognition error is detected for the banknote by the recognition unit.

5. The banknote processing device according to claim 1, further comprising a selection unit that selects the rejected note or the banknote other than the rejected notes as the banknote to be stacked in the second upper stacking unit, wherein the controller that, when the banknotes other than the rejected notes are selected by the selection unit, controls the transport unit to transport the banknote of a specific denomination to one of the first to fourth lower stacking units, transport the banknote other than the specific denomination to the second upper stacking unit, and transport the rejected note to the first upper stacking unit, and when the rejected notes are selected by the selection unit, controls the transport unit to transport the banknote other than the rejected note to one of the first to fourth lower stacking units and transport the rejected note to one of the first and second upper stacking units.

6. The banknote processing device according to claim 5, further comprising a storage unit that stores at least a first sort pattern for stacking the rejected notes in the second upper stacking unit, and a second sort pattern for stacking the banknotes other than the rejected notes in the second upper stacking unit, wherein the selection unit selects one of the first and second sort pattern stored in the storage unit.

7. The banknote processing device according to claim 5, wherein the first and second upper stacking units each have a first opening that opens in a same direction as the direction of openings of the first to fourth lower stacking units, and a second opening that opens in a direction toward the take-in unit.

8. The banknote processing device according to claim 1, wherein, when the recognition result obtained by the recognition unit for the banknote is not a rejected note, the controller judges a denomination first recognized by the recognition unit as the specific denomination.

9. The banknote processing device according to claim 1, wherein the first and second upper stacking units each have a first opening that opens in a same direction as the direction of openings of the first to fourth lower stacking units, and a second opening that opens in a direction toward the take-in unit.

10. The banknote processing device according to claim 4, wherein the first and second upper stacking units each have a first opening that opens in a same direction as the direction of openings of the first to fourth lower stacking units, and a second opening that opens in a direction toward the take-in unit.

11. The banknote processing device according to claim 1, wherein when the recognition result obtained by the recognition unit for the banknote is the specific denomination, the controller controls the transport unit to transport the banknote to one of the first to fourth lower stacking units according to an orientation of the banknote recognized by the recognition unit.

* * * * *